United States Patent [19]

Palmer

[11] 4,126,063

[45] Nov. 21, 1978

[54] WRENCH SOCKETS

[76] Inventor: Richard R. Palmer, 22 Parkview Dr., Painesville, Ohio 44077

[21] Appl. No.: 783,681

[22] Filed: Apr. 1, 1977

Related U.S. Application Data

[63] Continuation of Ser. No. 631,834, Nov. 14, 1975, abandoned.

[51] Int. Cl.[2] ..... B25B 13/06

[52] U.S. Cl. ..... 81/121 R

[58] Field of Search ..... 81/120, 121 R

[56] References Cited

U.S. PATENT DOCUMENTS

| | | | |
|---|---|---|---|
| 1,489,696 | 4/1924 | Campbell | 81/121 R |
| 1,504,035 | 8/1924 | Faw | 81/121 R X |
| 1,590,200 | 6/1926 | McGuckin | 81/120 |
| 3,495,485 | 2/1970 | Knudsen et al. | 81/121 R |
| 3,903,764 | 9/1975 | Andersen | 81/121 R |

*Primary Examiner*—Al Lawrence Smith
*Assistant Examiner*—James G. Smith
*Attorney, Agent, or Firm*—Teare, Teare & Sammon

[57] ABSTRACT

The invention relates to polygonal flank sockets, or drives, for correspondingly shaped fasteners which impart the torque turning load thereto, and more particularly relates to sockets and socket drives adapted to accommodate nut type fasteners that are complements thereof, of improved construction to more effectively sustain nut turning loads. The present arrangement insures surface-to-surface flat engaging contact between the splines and flanks of the nut fasteners for any purpose requiring torque or turning loads. In the present invention, straight surface-to-surface contact for load transmitting action is assured, whereby greater torque loads can be transmitted with the wrench socket embodying the teachings of the present invention.

4 Claims, 6 Drawing Figures

WRENCH SOCKETS

This is a continuation of application Ser. No. 631,834 filed Nov. 14, 1975 now abandoned.

BACKGROUND OF THE INVENTION

In the past, standard polygonal, such as hexagon, sockets usually comprise a series of oppositely disposed relatively inward and outward corners to correspond with and afford substantially exact registry with the nut fastener which is generally sized therefor. In prior arrangements, it is generally the corners of the standard sockets that, for the most part, carry the turning or the torque load imparted to the fastener nut and, therefore, the stress is the greatest in the weakest regions around the periphery of the wrench socket, namely, the flat areas of the socket. Heretofore, the effort has been toward reducing the socket wall thickness to afford a greater bite action on the nut to facilitate tightening and/or loosening of the nut. However, such efforts have not been satisfactory in providing efficient torque transmitting characteristics and longer life to both the wrench sockets and to the nut fasteners employed therewith. In the present invention, there is provided an improved construction of a wrench socket which affords efficient torque transmission and which affords clearance of the nut corner to insure removal of the nut. By this arrangement, the nut fasteners are engaged offset from their corners and on their respective flat surfaces so that greater torque loads can be transmitted from the socket to facilitate difficult to remove type nuts, such as those rusted in place or otherwise difficult to remove. Typical of the prior art wrench sockets include:

U.S. Pat. Nos. 2,848,916; 2,578,686; 2,664,770; 3,495,485; 3,675,516.

In the past, various arrangements have been provided for transmitting the torque turning load to the sides or flanks rather than to the corners of the nut. In U.S. Pat. Nos. 3,273,430 and 3,675,516, for example, the inner surfaces of the socket have been angulated (e.g., 144 degrees) relative to the axial direction of the socket to provide side drive engagements for the fastener nut with the nut corners located within the corners. In such arrangements, however, turning movement is imparted to the nut by the straight line sidewalls of the socket.

SUMMARY OF THE INVENTION

A wrench socket, or the like, for transmitting a torque load to a nut-type fastener comprising, a closed socket body member having a polygonal axially ending bore therethrough adapted for receiving a polygonal shaped nut fastener for imparting rotary movement thereto, said bore defined by a plurality of sets of equidistantly spaced and radially disposed inner linear tapered serrations oriented in a common plane for surface-to-surface engagement with the corresponding flat side surfaces of the nut fastener, a plurality of arcuate concavities disposed intermediate each of the nut sets of serrations adapted for reception of the corners of the nut fasteners for the transmission of a torque load in a direction away from the corners of said nut fastener. Further, the serrations are triangularly shaped and extend parallel to one another the full length of the bore and in a converging relation from the entry end of the socket. Preferably, the serrations have an included angle of approximately 60 degrees with the maximum widthwise dimension of the base (e.g., short side) being approximately 0.075 inch. In a preferred form, for a hexagonal nut fastener there are between 4 and 5 serrations per tapered serration throughout the periphery of the bore in the socket. In a square sided nut, for example, there may be between 8 and 10 serrations per concavity. In addition, in a preferred form of the invention, the serrations contiguous to the concavities have an outside angle of approximately 30 degrees to merge with said concavities to accommodate the corners of said nut fasteners.

DESCRIPTION OF THE PREFERRED EMBODIMENTS

Figure 5:
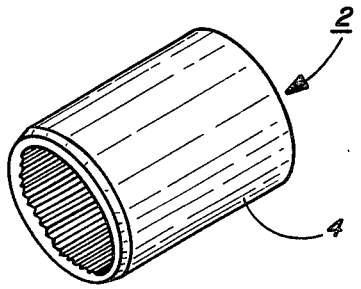
FIG. 5 is a perspective view of the wrench socket embodying the present invention.

Referring again to the drawings, the wrench socket illustrated is not intended to serve as a limitation upon the scope of the invention, but is merely illustrative thereof. For example, there may be various other adaptations of all or part of the invention contemplated herein such as in box members and allen wrenches. More particularly, referring to FIG. 5, there is shown a wrench socket, designated generally at 2, having a cylindrical body member 4. In the embodiment shown, the member 4 has a polygonal, such as square-shaped bore 6 for receiving a correspondingly shaped but slightly smaller drive shaft for detachable connection for imparting rotation thereto, as known in the art.

Figure 3:
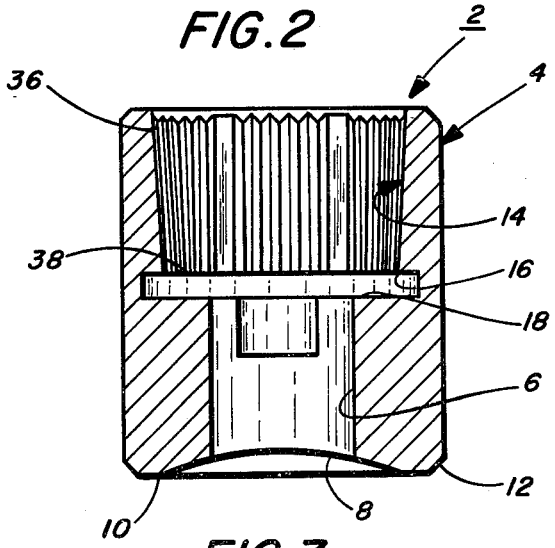
FIG. 3 is a vertical section view taken along line 3—3 of FIG. 2.

As best seen in FIG. 3, the body member 4 is dished-out, as at 8, in the peripheral area immediately around the bore 6 and merges with a generally flat cylindrical surface area, as at 10, which in turn is angularly chamfered, as at 12. The bore 6 is of a reduced transverse dimension and axially communicates with a polygonal, such as hexagonal, socket 14 which may be broached to the shape illustrated. The socket 14 communicating with the bore 6 acts to provide a passageway so that chips resulting from broaching of the socket 14 during manufacture thereof. In the invention, the bore 6 is separated from the socket 14 by an intermediate annular recess, as at 16, which has a radial depth greater than the maximum transverse dimension of the bore 6 and socket 14. The recess 16 provides a shoulder-like construction, as at 17, which provides a clearance area between the socket and the bore 6 and an abutment for a fastener nut when registered within the socket 14. By this arrangement, the wall thickness defining the bore 6 is maximized to provide optimum driving rotation to the nut fastener.

Figure 1:
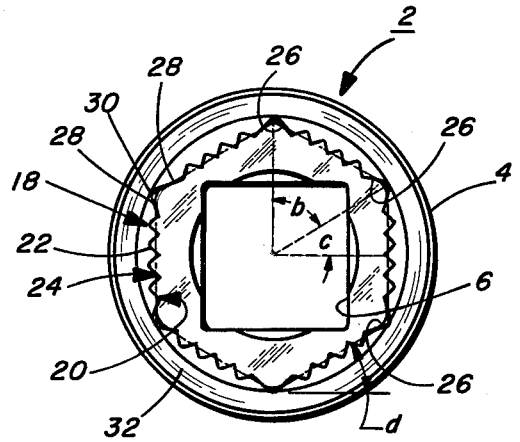
FIG. 1 is an end elevation view embodying the present invention, the nut fastener being shown in dotted line.
Figure 6:
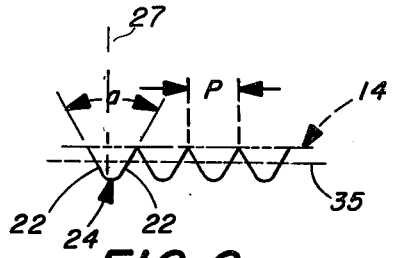
FIG. 6 is a diagrammatic illustration representing the serration construction of the wrench socket of the present invention.

In accordance with the invention, the driver or socket 14 is specially constructed and arranged to provide a gripping surface-to-surface engagement relative to a complemental nut fastener disposed for turning registry therewith. Referring to FIG. 1 and for this purpose, the socket 14 is defined by a series of equidistantly spaced and circumferentially oriented side engaging lands, designated generally at 18, which extend generally linearly and angularly with respect to the surfaces of the bore 6. In the form shown, each land 18 comprises a plurality of splines or serrations 20. As seen, in FIG. 1, the serrations 20 are (5) in number and extend inwardly toward the longitudinal central axis of the body member 4. The serrations 20 are each defined by root sides 22 which are angularly oriented at a preferred angle (a) such as approximately 60 degrees (FIG. 6) and a base (pitch distance) *p* of 0.075 inches. The root sides 22 converge in a direction away from the longitudinal central axis of the body member 4 so as to intersect at a sharp triangular apex, as at 24, providing the serrations 20 with a triangular configuration, in cross section, for gripping surface-to-surface engagement with the nut fastener. As seen in the drawings, the root sides 22 of the serrations are disposed so that an imaginary bisector 27 of the included angle between the root sides is perpendicular to the confronting faces of the fastener.

In the invention, the lands 18 each define a sector disposed at an angle (b) of approximately 60° relative to the geometric center of the socket 14 so that one-half the sector defines an angle (c) of approximately 30° with the mod-point of an adjacent corner 26.

In the invention, the lands 18 are separated at the corners by equidistantly spaced outer linear corners or flutes 26 that provide the outer (6) corners of the socket in the form illustrated in FIG. 1. In the embodiment shown, each flute 26 defined by root sides 28 which converge in an apex end 30 which is disposed in 20. However, in the invention, the root sides 28 defining the flutes 30 merge with the corresponding root sides 22 of adjacent serrations 20 by an angle (d) of approximately 30 degrees so as to correspond to the complementary flat side of the fastener nut.

In the preferred embodiment, the lands 18 constitute the load bearing surfaces for coacting engagement with the confronting flat surfaces of the nut fastener with the flute corners 26 providing a minimum clearance for registration with the nut fastener corners. Thus, the arrangement provides a maximum surface-to-surface gripping engagement with the confronting surfaces of the nut fasteners for optimum torque loading. Accordingly, the wrench socket wall 32 has a generally uniform thickness throughout its periphery for uniform stress transmission for tightening or loosening the fasteners. Further, by this arrangement, damage or wear on the corners of the nut fasteners is substantially eliminated, while at the same time assuring minimum looseness and good registry with the nut fasteners during loosening or tightening of the fasteners. With the present invention, the torque load is distributed generally evenly throughout the inner periphery of the wrench socket thereby enabling use of lesser wall thickness materials within practical requirements of a given usage.

In the invention, it has been found that preferred results are obtained when the root sides 22 of the outermost serrations 20 and the adjacent root sides 28 of the associated flutes 26 are angularly oriented with respect to one another. In the form shown, the preferred ratio of angularity is 1:2. Also, it is found to be advantageous and critical that the apex ends of the serrations 24 and flutes 30 extend in the same plane. Also, it has been found in the invention that the pitch diameter, as at 35, of the serrations (FIG. 6) may be reduced (e.g., height of the serration) in relation to a conventional size nut or bolt so as to be driven on to insure a positive gripping engagement thereon. Further, in the invention, and as best seen in FIG. 3, the serrations 20 and flutes 26 may extend parallel to one another throughout the full length of the body 4 up to the recess 16. As best viewed in FIG. 3, the serrations may be inclined or tapered in a lengthwise direction, as at from 36 to 38, such as at an angle from 5° to 10° to facilitate insertion onto a fastener to be removed, as desired.

Figure 2:
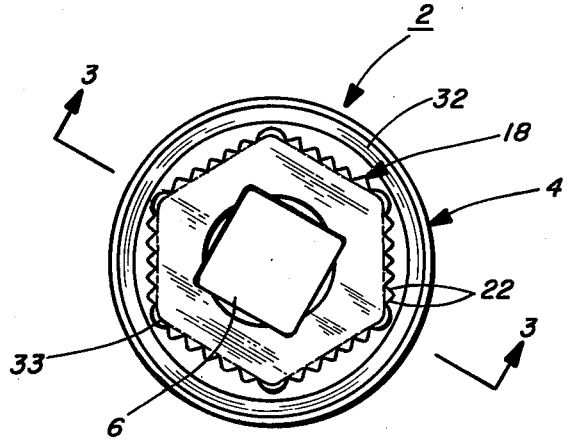
FIG. 2 is a modified form of the wrench socket with the nut fastener shown in dotted line.

In FIG. 2, there is illustrated a modified form of the wrench socket. In this form, the socket device is generally of the same construction as that shown in FIG. 1, except that the bore 7 is of a reduced cross-sectional size and in respect to the construction of the inner socket. In this form, the corners are in the form of arcuate concavities 33 which have their lowermost portions, as at 37, disposed in the same general plane as the apex ends 24 of the serrations 20. Here, there are four serrations for each land 18, as shown.

In the invention, it will be understood that the socket construction of FIG. 1 may be employed with the body 4 construction in FIG. 3 or vice versa, as desired. Hence, the socket may be of any interior polygonal configuration, while the bore 6 and 7 may be of any size of polygonal (e.g., square) shape as desired.

Figure 4:
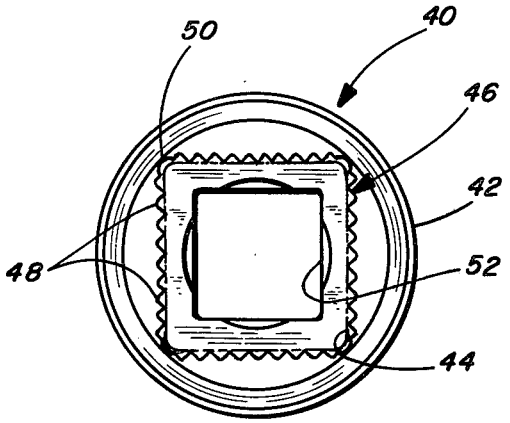
FIG. 4 is a front elevation view illustrating another modified form of the wrench socket of the present invention with the nut fastener illustrated in dotted line.

In FIG. 4, there is illustrated a modified form of the wrench socket device of the present invention, designated generally at 40, which includes a similar cylindrical body member 4 of identical construction to that shown in FIGS. 1 to 3. In this form, however, the interior socket 44 is of a polygonal, such as square, shaped configuration having four lands 46 defined by the serrations 48 of the invention. Here again, the lands are separated by flutes 50 which have the apex ends of the serrations 48 and the base of the flutes disposed substantially in the same general plane with one another. In this form, the socket similarly communicates with a drive bore 52, in this instance having a square-shaped configuration, for receiving a correspondingly shaped but slightly smaller drive shaft adapted for registration therewith for imparting turning movement to the wrench socket and hence, to the fastener to be removed.

I claim:

1. A wrench socket device for transmitting a torque load to a nut-type fastener comprising, an elongated body having a polygonal shaped bore extending axially therethrough, said bore defined by a plurality of sets of equidistantly spaced and radially extending inner tapered serrations disposed in a substantially common plane for surface-to-surface engagement with corresponding generally planar side surfaces of a fastener across substantially the entire surface thereof, a plurality of arcuate concavities disposed generally intermediate each of the sets of serrations adapted for reception of the corners of said fastener for transmitting a torque load thereto in a direction away from the corners of said fastener, said concavities each include outer corners in the form of flutes defined by root sides which converge in apex ends, the root sides of each of said flutes converge in an apex end which is disposed in the general plane of the apex ends defined by said serrations, and the sides of said flutes merged with the corresponding sides of serrations by an angle of approximately 30°, said serrations define a plurality of lands disposed at an angle of approximately 60° relative to the geometric center of said bore such that approximately ½ of a sector provides an angle of approximately 30° in respect to the mid-point of an associated one of said concavities, said serrations each have an included angle of approximately 60° with the bisector of the root sides of the serrations being perpendicular to the confronting planar side surfaces of the fastener.

2. A wrench socket device in accordance with claim 1, wherein the root sides of serrations and flutes are angularly oriented in a ratio of 1:2.

3. A wrench socket device in accordance with claim 1, wherein said serrations are tapered in a lengthwise direction at an angle from 5° to 10°.

4. A wrench socket device in accordance with claim 1, wherein the pitch diameter of serrations is predetermined in relation to the size of a nut or bolt to be driven.

* * * * *